US005824997A

United States Patent [19]

Reichle et al.

[11] Patent Number: 5,824,997

[45] Date of Patent: Oct. 20, 1998

[54] RAILROAD TRACK SWITCH HEATER

[75] Inventors: David L. Reichle, Littleton, Colo.; William P. Washington, Irving, Tex.

[73] Assignee: Fastrax Industries, Inc., Englewood, Colo.

[21] Appl. No.: 691,954

[22] Filed: Aug. 5, 1996

[51] Int. Cl.[6] ..... H05B 3/06

[52] U.S. Cl. ..... 219/537; 246/428; 219/536

[58] Field of Search ..... 219/213, 536, 219/537, 541; 246/428

[56] References Cited

U.S. PATENT DOCUMENTS

| | | | |
|---|---|---|---|
| Re. 31,081 | 11/1982 | Keep, Jr. | 246/428 |
| 2,910,567 | 10/1959 | Holstein | 219/536 |
| 3,233,097 | 2/1966 | Watkins | 246/428 |
| 3,243,573 | 3/1966 | Weisse et al. | 219/537 |
| 3,264,472 | 8/1966 | Simmons | 246/428 |
| 3,349,722 | 10/1967 | Davis | 246/428 |
| 3,394,251 | 7/1968 | King et al. | 219/537 |
| 3,439,161 | 4/1969 | McElwee et al. | 246/428 |
| 3,697,746 | 10/1972 | Patterson et al. | 246/428 |
| 4,195,805 | 4/1980 | Keep, Jr. | 246/428 |
| 4,391,425 | 7/1983 | Keep, Jr. | 246/428 |
| 4,671,475 | 6/1987 | Widmer | 246/428 |
| 5,004,190 | 4/1991 | Montierth et al. | 246/428 |

*Primary Examiner*—Tu Ba Hoang
*Attorney, Agent, or Firm*—Holme Roberts & Owen LLP

[57] ABSTRACT

A high efficiency, direct conduction track switch heater (24) and associated spring clamp (70) are disclosed. The heater (24) includes a generally blade-shaped jacket (30) dimensioned for mounting on the gauge side 26 of a fixed rail (16) at the track switch interface. The jacket dimensions reduce the likelihood of impact damage due to track switching while providing an enlarged heat transfer surface (66). The spring clamp (70) presses the heater (24) tightly against the rail (16) while accommodating normal thermal expansions and providing a narrow profile for the overall heater and clamp assembly.

31 Claims, 5 Drawing Sheets

RAILROAD TRACK SWITCH HEATER

FIELD OF THE INVENTION

The present invention relates to railroad track switch heaters and, in particular, to an improved direct conduction track switch heater which can be mounted on the gauge side of a track at the track switch interface of reinforced or non-reinforced switches.

BACKGROUND OF THE INVENTION

Railroad track switches typically involve a pair of stationary rails and a pair of switching rails that move between engaged and disengaged positions. In the engaged position, commonly referred to as the "reverse position," a switching rail abuts the gauge side of a stationary rail, i.e., the side which engages the flange of a train wheel, so as to divert the train wheel from the stationary rail and the corresponding track to another track. In the disengaged position, commonly known as the "normal position," the switching rail is separated from the gauge side of the stationary rail so that a passing wheel is unaffected by the switching rail.

In order to ensure proper functioning of a railroad switch, it is important that the switching rail and stationary rail make good contact in the engaged position. Accordingly, in cold climates, it is common to heat the rail switch or otherwise guard against build up of ice or snow at the switch, especially at the interface between the gauge side of the stationary rail and opposite side of the switching rail.

It will be appreciated that a malfunctioning switch presents a danger of derailment resulting in severe personal and property damage. Although switches are now normally equipped with sensors to provide advance warning in the event of a potentially malfunctioning switch, switch contact problems are nonetheless a hazard, can result in considerable delay and annoyance, and are a significant burden to the rail transportation system in cold climates.

A number of different types of track switch heaters have been devised including heaters that operate on radiant (e.g., infrared element), convective (e.g., forced air); and/or conductive (e.g., electrical heater element) principles. Among these, certain heaters have relative advantages for particular applications based on efficiency, availability of an appropriate power source at a remote location or other considerations.

However, known track switch heaters are subject to one or more of the following disadvantages. First, some heaters can be damaged or can become worn due to repeated movement of the tracks incident to switching. In addition, some heaters are inefficient due to their reliance on convective or radiant heating. Other heaters are inefficient due to use of a small surface area for conductive heat transfer or uneven heat distribution across the heat transfer surface. In this regard, rounded heater element housings have a limited area of direct thermal contact and, in operation, such contact may be further limited if the housing becomes disfigured due to thermal warping or impact. Moreover, some heaters are inefficient due to reliance on heat conduction through a railroad rail from a remote heat transfer surface (e.g., on the rail side away from the switch interface) to the switch interface.

SUMMARY OF THE INVENTION

Accordingly, objectives of the present invention include the following:

The provision of a heater with improved resistance to physical damage and wear in the track switch environment including reinforced and non-reinforced track switches;

The provision of a direct conductive track switch heater with improved efficiency;

The provision of a track switch heater which can be mounted on the gauge side of a track to directly deliver heat at the track switch interface;

The provision of a conductive track switch heater with an enlarged heat transfer surface;

The provision of a conductive track switch heater with improved heat distribution across an enlarged heat transfer surface; and The provision of an electrical track switch heater with reduced power consumption.

Additional objectives and advantages of the present invention will be apparent upon consideration of the present disclosure.

According to one aspect of the present invention, a track switch heater including a conductive heater unit with a narrow profile and an enlarged heat transfer surface is provided. The heater unit is dimensioned to reside within the recess (web area) of the gauge side of a rail at the track switch interface. The heater unit has a thickness, measured transversely to the rail side, of no more than about 0.4 inches and a substantially flat heat transfer surface having a vertical height of no less than about 0.5 inches. In a preferred embodiment, the heater unit is generally bladeshaped having a thickness of no more than about 0.25 inches and a flat heat transfer surface, abutting the gauge side of a rail, that is no less than about 1.0 inch tall. The heater unit is preferably at least about 6.0 feet long and, more preferably at least about 9.0 feet long. In one embodiment, the unit is more than 12.0 feet long. The heater unit provides improved avoidance of impact damage due to contact with switch rails and switch actuator arm or tie-rod components, and an improved heat transfer surface area as compared to known circular cross-section heater units.

A novel mounting element for securing the heater to the rail is also provided according to the present invention. The mounting element is adapted for mounting on the gauge side of a rail at the switch interface and has a narrow profile to reduce the likelihood of impact damage due to switching. In addition, the mounting element accommodates and compensates for normal thermal expansions and contractions and related relative motion between the heater unit and the rail to enhance thermal conduction. The mounting element includes a first portion for mounting on the gauge side of the rail, a second portion for engaging the heater unit in a manner that permits longitudinal sliding movement of the heater unit but substantially prevents vertical movement, and a mechanism for resiliently urging the heater unit against the rail side to maintain positive heat transfer surface contact.

Preferably, the mounting element extends no more than 0.25 inches beyond the thickness of the heater unit from the surface of the rail and, more preferably, no more than about 0.125 inches. In one embodiment, the mounting element is provided in the form of a bracket that is attached to the rail above or beneath the heater unit (such attachment being accomplished substantially within the thickness envelope defined by the heater unit) and engages the heater unit on bottom, top and side facing surfaces of the heater unit. A spring element may be provided between the bracket and the heater unit for enhanced heater/rail contact.

According to another aspect of the present invention, the heater unit has improved heat distribution across the enlarged, flat heat transfer surface due to the vertical distribution of resistive heater element components across the heat transfer surface. In this regard, at a given longitudinal location, the heater unit includes a first resistive heater element component located a first horizontal distance from the heat transfer surface and a second resistive heater element component located substantially the same first horizontal distance from the heat transfer surface and further being located a second vertical distance from the first resistive heater element component. The second vertical distance is preferably no less than about 0.25 inches and, more preferably at least about 0.375 inches. The first and second heater element components can be provided, for example, as separate resistive strands arranged in a substantially parallel manner, a single wide, flat resistive strip, or a single elongate strand formed in a serpentine pattern. In one embodiment, three parallel, vertically spaced heater elements are employed for enhanced heat distribution relative to the height of the heat transfer surface.

The present invention thus provides a track switch heater with improved resistance to damage in the track switch environment and improved heating efficiency. In addition, the invention allows for reduction in operating temperatures, thereby reducing safety concerns and dimensional distortion. In the latter regard, the present invention has been found to perform well at operating temperatures of only 400° F., whereas certain known heaters have been operated at 1200° F. It is also anticipated that the lower operating temperatures will contribute to extended unit lifespan.

BRIEF DESCRIPTION OF THE DRAWINGS

For a more complete understanding of the present invention and further advantages thereof, reference is now made to the following Detailed Description taken in conjunction with the drawings in which.

DETAILED DESCRIPTION OF THE PREFERRED EMBODIMENT

Figure 1:
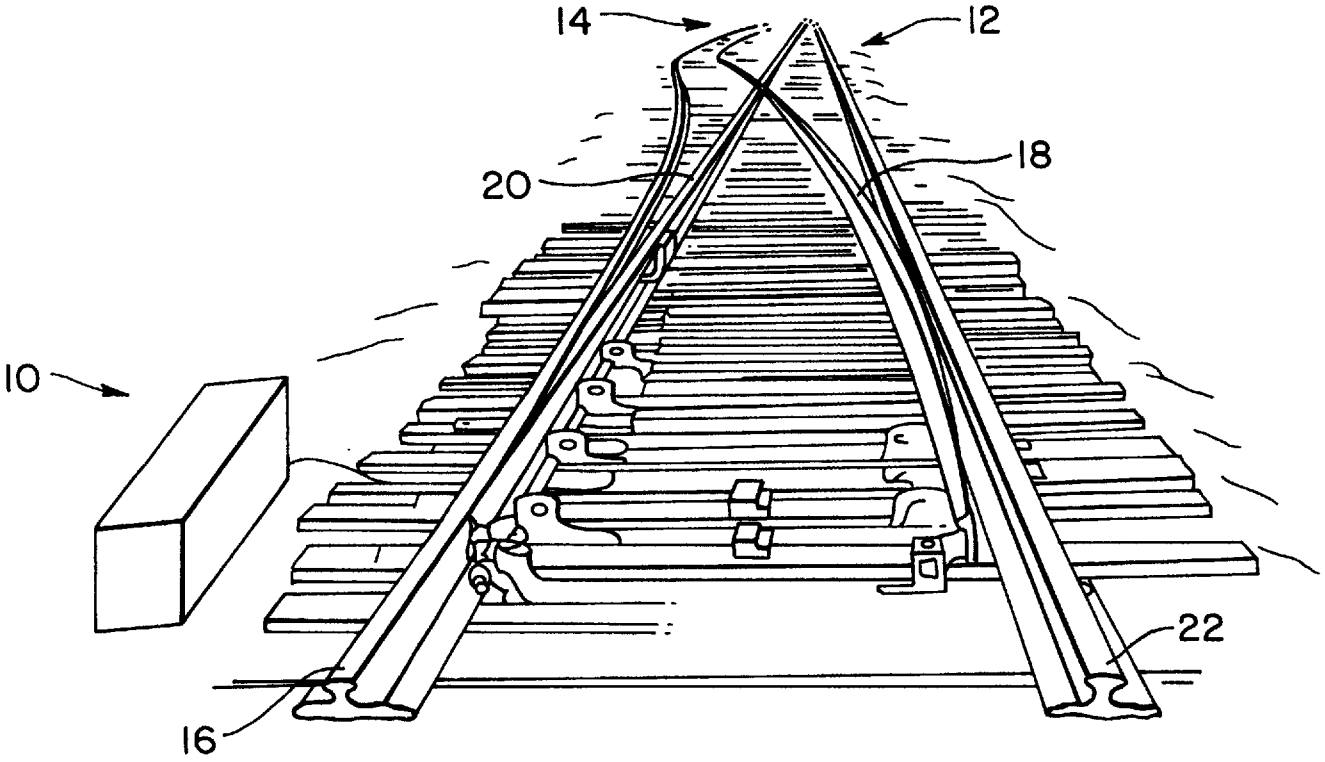
FIG. 1 is a perspective view showing a railroad track switch.

Referring to FIG. 1, a railroad track switch is generally identified by the reference numeral 10. The track switch 10 is used, for example, to switch train traffic between first 12 and second 14 tracks. Generally, the switch 10 includes a pair of fixed rails 16 and 22 and a pair of switching rails 18 and 20.

The switching rails 18 and 20 are positioned on the gauge (inner) side of each of the fixed rails 16 or 22 and are movable between reverse and normal positions. In FIG. 1, the first switching rail 18 is disengaged from the first fixed rail 22 and the second switching rail 20 is engaged to the second fixed rail 16. In this configuration, the switch 10 is set to select the first track 12. To select the second track 14, the switching rails 18 and 20 can be shifted in unison to the right, as viewed in FIG. 1, so that the first switching rail 18 abuts the first fixed rail 22 and the second switching rail 20 is disengaged from the second fixed rail 16.

It will be appreciated that proper operation requires good contact between the fixed rail 22 and switching rail 18 in the reverse position and between the fixed rail 16 and switching rail 20 in the normal position. The heater of the present invention enhances switch operation by reducing or substantially eliminating build up of ice or snow at the switch interface.

Figure 2A:
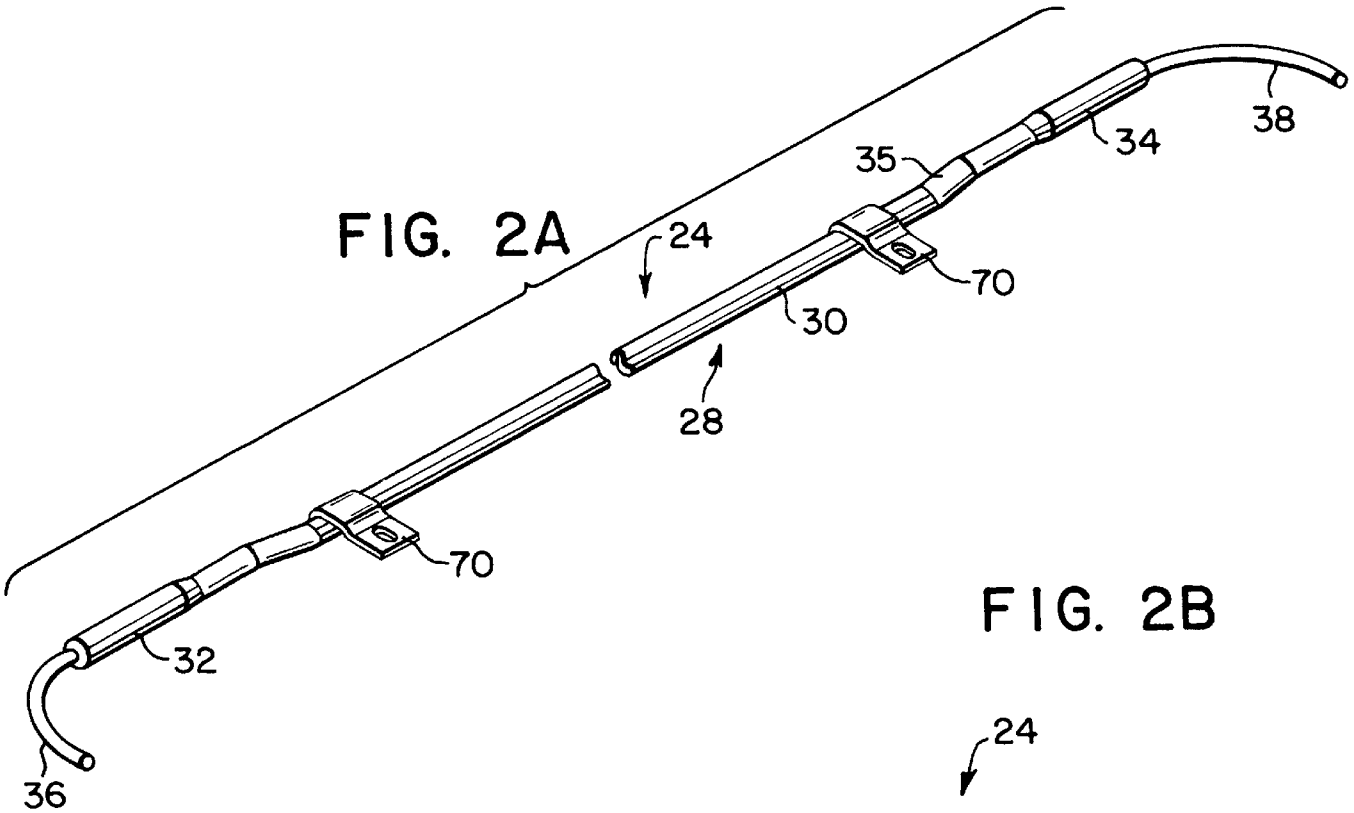
FIG. 2*a*, is a perspective view showing a track switch heater in accordance with the present invention.
Figure 2B:
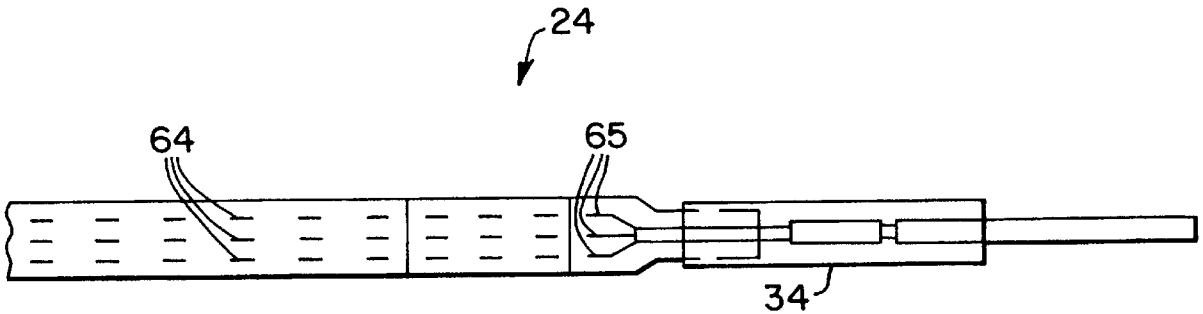
FIG. 2*b* shows details of a terminal of the track switch heater of FIG. 2*a;*
Figure 3:
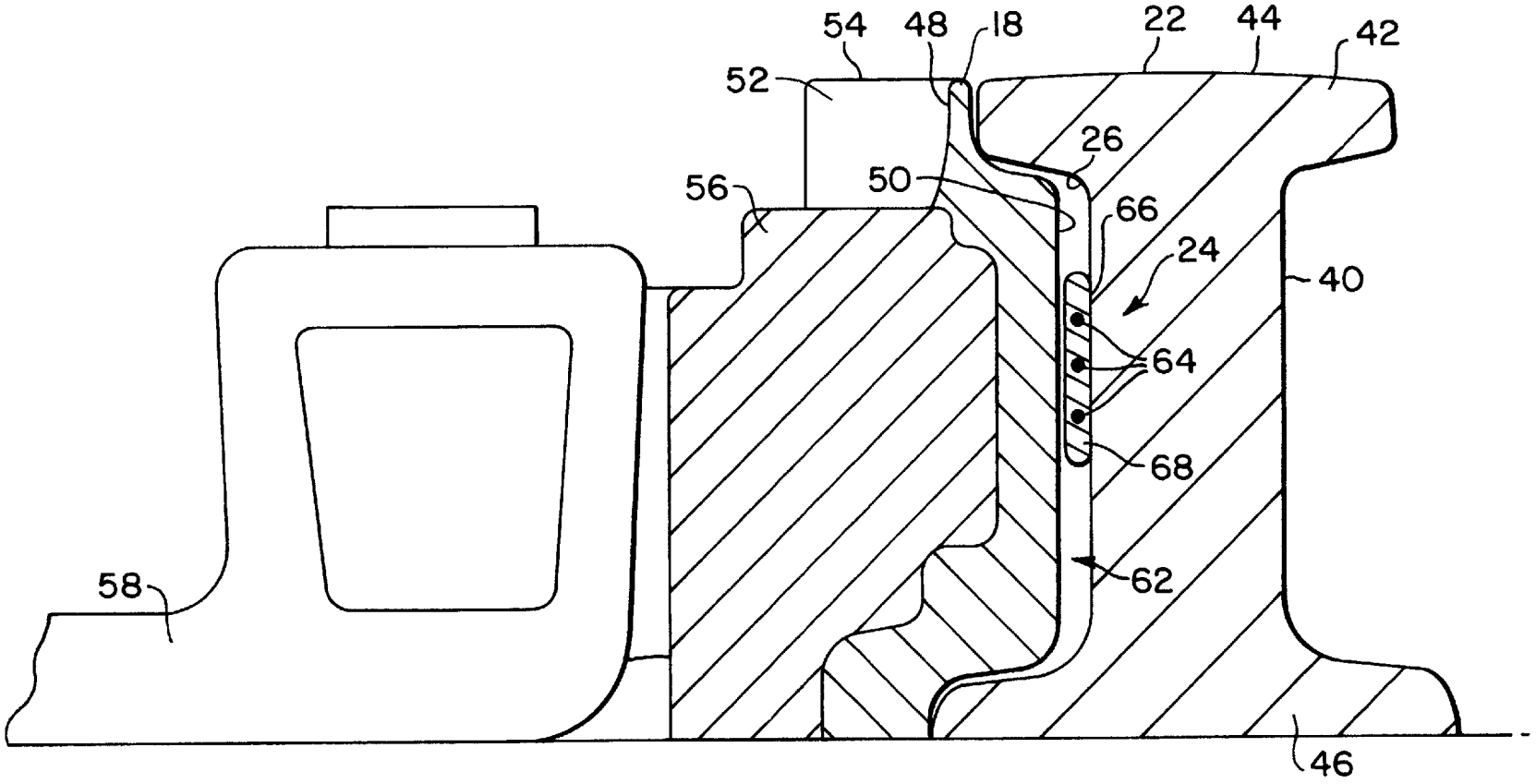
FIG. 3 is a transverse cross-sectional view showing the track switch heater of FIG. 2*a* mounted on the gauge side of a rail at the track switch interface.

Referring to FIGS. 2*a*–3, a track switch heater 24 according to the present invention is shown. FIG. 2*a* shows a perspective view of the heater 24 and FIG. 2*b* shows internal details of a heater terminal, where the terminal exterior is indicted in phantom. FIG. 3 shows a transverse cross-sectional view of the heater 24 mounted on the gauge side of a fixed rail, for example, first fixed rail 22.

As shown in FIGS. 2*a* and 2*b*, the heater 24 includes an elongate housing 28 having a blade-shaped central jacket 30 and terminal sleeves 32 and 34 at each end. The illustrated housing is 12 feet 9.5 inches long with the jacket 30 accounting for just over 12 feet of the total housing length.

FIG. 2*a* further shows electrical lines 36 and 38 connecting the heater 24 to an external power source (not shown) such as a utilities outlet or, in remote locations, a generator or other independent source. For the illustrated heater 24, the power source delivers 3,000 watts of electrical power at 240 volts. Upon consideration of the description below, it will be appreciated that the terminal sleeves 32 and 34 at either end of the heater 24 and the associated power line 36 or 38 can be eliminated for embodiments where the internal heater element(s) is folded so that the terminals thereof are located at one end of the heater 24. The electrical lines 36 and 38 are connected to the terminals of the internal heater element(s) within the terminal sleeves 32 and 34 which are sealed against the elements. In the illustrated embodiment as shown in FIGS. 2*b* and 3, the heater 24 includes three heater elements 64 tig welded near the terminal housing to internal cold pins 65. The cold pins 65 establish an electrical connection to the heater elements 64 while substantially thermally isolating the terminal components from the heater elements 64. At the terminal 34, the cold pins 65 are tig welded together prior to crimping. For protection against the elements, the cold pins 65 are encapsulated in epoxy and a silicon/fiber glass or other insulator is provided within the terminal housing. In the illustrated embodiment, more than 3 inches of insulation, preferably about 4 inches, are employed to ensure adequate protection. At the terminal, the cold pins are tig welded to a highly flexible and resilient shipboard type cable, such as the cable marketed under the brand name "GEXOL." It will be appreciated that the various tig welds greatly enhance the tensile strength of the overall heater circuit.

In order to withstand prolonged exposure to the elements and the rugged track switch environment, the housing 28 must be constructed from a durable material. In addition, it is desired that the housing 28 provide a degree of flexibility or malleability in order to conform to and accommodate rail contours or irregularities over the length thereof so as to maintain good thermal contact. Moreover, at least the heat transfer surface of the jacket 30, i.e., the major side of the jacket 30 that abuts the rail, should possess good heat conduction properties. The illustrated housing 28 is formed from steel or metal alloy approximately 0.25 inches thick. The terminal sleeves 32 and 34 each have a circular cross-section with an outside diameter of about 0.812 inches. In this regard, it will be appreciated that the terminal sleeves can be located away from the track switch interface where thickness-concerns are somewhat abated. In addition, an end portion 35 of the housing 28 can be sloped to accommodate the increased sleeve thickness with reduced stress. The illustrated housing 28 is smoothly tapered from the circular sleeves 32 and 34 to the blade-shaped jacket which has a width (or vertical height when mounted as shown in FIG. 3) of about 1.0 inch and a thickness of about 0.25 inches. A rectangular sleeve, cables and transition may be employed, for example, to reduce sleeve thickness and increase rail mount stability.

FIG. 3 shows fixed rail 22 and switching rail 18 in an engaged position. Fixed rail 22 includes a gauge side 26 for engaging the flange of a train wheel, an opposite side 40, a head flange 42 including wheel-bearing surface 44, and a base or mounting flange 46 for staking to underlying railroad ties. Similarly, switching rail 18 includes a gauge side 48 for engaging the flange of a train wheel, an opposite side 50, head flange 52 including wheel bearing surface 54, and mounting block 56 for mounting switching rail 18 on a moveable actuator arm 58. The illustrated switch is a so-called reinforced switch with low clearance between the switching rail 18 and the web of fixed rail 22. The switching rail 18 is moveable between engaged and disengaged positions by manual or motor driven operation of the actuator arm. These components are further designed to ensure concerted switching of both switching rails 18 and 20.

In the engaged position as shown, the opposite side 50 of switching rail 18 closely abuts against the gauge side 26 of fixed rail 22 in the vicinity of the head flanges 42 and 52. However, due to the recessed configuration of the gauge side 26 of fixed rail 22 and/or the opposite side 50 of switching rail 18 a gap 62 is defined at the switch interface. The gap 62 typically has a maximum width, measured from the gauge side 26 to the opposite side 50 of the abutting rails 18 and 22, of approximately 0.375 inches if the switch is of the reinforced type as shown and 0.875 inches for the non-reinforced type, although mounting lugs and other objects may intrude into this region. Due to gap variances, intruding objects at the interface and other factors, it has been found that certain known circular contours cross-section heaters can experience impact damage if mounted at the interface. Such damage, in addition to diminishing heater effectiveness and lifespan, can result in electrical hazards. The heater 24 is mounted within the gap 62 high on the gauge side 26 of the fixed rail 22 to directly heat the switch interface and reduce snow or ice accumulation between the rails 18 and 22.

The cross-section of the rail heater 24 can also be seen in FIG. 3. The illustrated heater 24 includes three resistive heater element strands 64 distributed across the height of the heater 24. The strands may comprise, for example, known unbraided, blade-shaped Nichrome heater elements. The strands 64 are spaced at substantially equal vertical intervals, e.g., approximately 0.25 inches apart, to provide more even heat distribution at the heat transfer surface 66 of heater 24. Additionally, each of the strands 64 is positioned approximately the same horizontal distance, e.g., approximately 0.125 inches in the illustrated embodiment, from the heat transfer surface 66 for improved heat distribution and to maintain consistent electric insulation values. Although three parallel strands are employed in the illustrated embodiment, a different number of strands, a single wide heater element strip, a single strand formed in a serpentine pattern or other heater element arrangements could be utilized.

A filler 68 is provided between the strands 64 and the housing 28. The filler 68 serves a number of functions including providing electrical isolation of the strands 64 and conducting heat between the strands and the heat transfer surface 66. The filler 68 is therefor preferably a material having good electrical insulation and heat conduction properties, such as various dielectric materials. It is also desirable that the filler be flexible or malleable to accommodate bending of the heater 24 to conform to contours or irregularities of the fixed rail 22. In the illustrated embodiment, Magnesium Oxide (MgO) is employed for the filler material.

In order to mount the heater 24 in a manner which maintains good thermal contact between the heat transfer surface 66 and the fixed rail 22 with minimal total heater/mount thickness, thereby reducing the likelihood of impact damage, spring clamps 70, as shown in FIGS. 2*a* and 4*a*–4*c*, are utilized. The illustrated spring clamp 70 includes a mounting surface 72 for attachment to the gauge side 26 of fixed rail 22 using a bolt or the like and a bracket 76 for engaging the heater jacket 30, interconnected by an arm 78. The bracket 76 is shaped to generally conform to the jacket 30 and includes a top lip 80 for engaging an upwardly facing surface of the jacket 30, a face portion 82 for engaging an outwardly facing surface of the jacket 30, and a bottom lip 84 for engaging a downwardly facing surface of the jacket 30. In this manner, the spring clamp 70 maintains the jacket 30 in a substantially fixed vertical position and presses the jacket 30 tightly against the rail 22, while accommodating thermal expansion/contraction, longitudinal sliding of the jacket 30 and thickness variations, e.g., due to rail contours or irregularities.

Figure 4A:
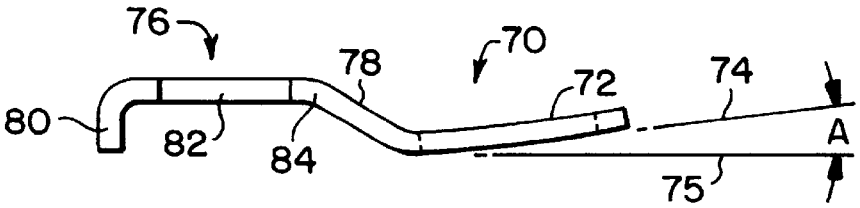
FIG. 4*a* is a transverse cross-sectional view of the mounting spring clamp of the present invention.
Figure 4B:
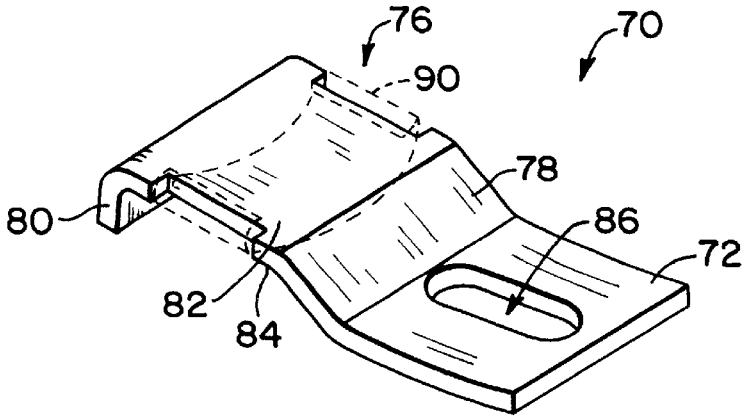
FIG. 4*b* is a perspective view of the spring clamp of FIG. 4*a;*
Figure 4C:
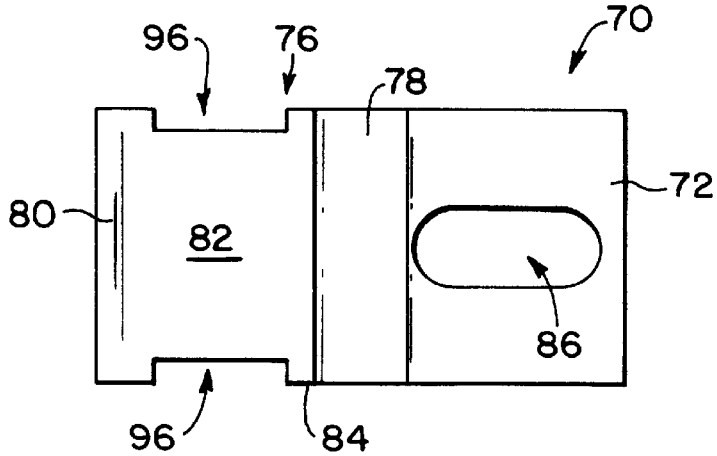
FIG. 4*c* is a top view of the spring clamp of FIG. 4*a;*
Figure 5A:
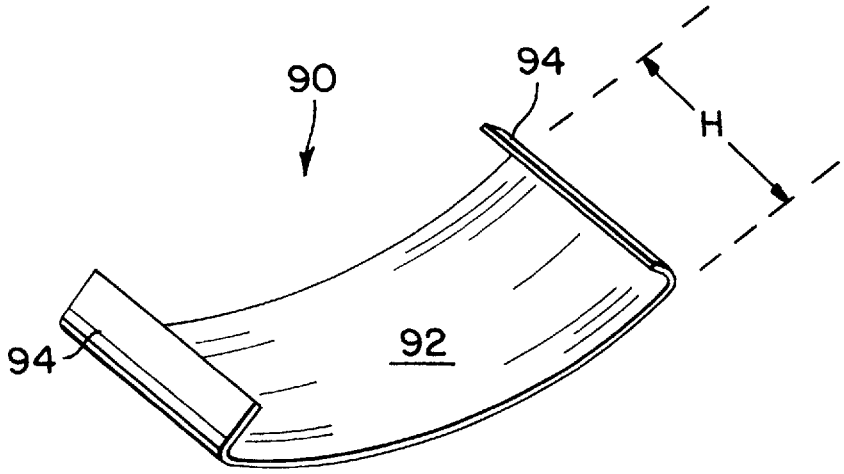
FIG. 5*a* is a perspective view of a contact spring for use in combination with the spring clamp of FIG. 4*a*.
Figure 5B:
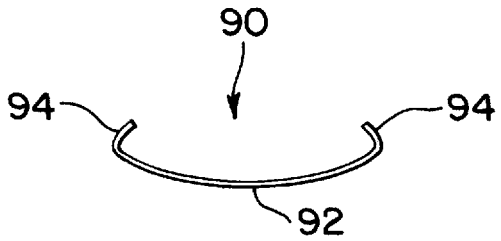
FIG. 5*b* is a transverse cross sectional view of the contact spring of FIG. 5*a*.

As can be seen in FIG. 4*a*, the mounting surface 72 is preferably curved and is oriented such that a chord line 74 of surface 72 is sloped at an angle A relative to longitudinal axis 75. The illustrative mounting surface has a radius of curvature of approximately 8 inches and a slop angle A of about 7°. The overall configuration of the clamp 70 helps to press the heater jacket 30 tightly against the rail 22 when the attaching bolt is tightened.

The illustrated spring clamp 70 is formed from a single sheet of steel or metal alloy and has a thickness of about 0.125 inches and a width of about 1.5 inches. The mounting surface is about 1.3 inches high and includes an oblong opening 86 to facilitate vertical heater/clamp alignment. The face portion 82 of bracket 76 is about 0.95 inches tall and top lip 80 extends inwardly about 0.4375 inches relative to the outer surface of face portion 82. The arm 78, which also defines the bottom lip 84 of bracket 76, has a vertical height of about 0.56 inches and is angled at about 30°. For improved strength and flexibility, the bends are filleted using a bending radius of approximately 0.06 inches.

The illustrated heater/clamp assembly thus defines a thickness envelope relative to gauge side 26 of fixed rail 22 of only about 0.475 inches. Moreover, due to the vertical displacement of the mounting surface 72 relative to the bracket 76 and heater jacket 30, the head of a mounting bolt can be disposed substantially within the heater/clamp thickness envelope.

Referring to FIGS. 4*a*–5*b*, to further ensure good thermal contact between the jacket 30 and rail 22, a contact spring 90 is mounted on the inside surface of bracket 76 to urge the jacket 30 against the rail 22. The contact spring 90, which may be constructed from a beryllium copper sheet 0.008 inches thick, includes an arcuate contact area 92 and mounting flanges 94. The contact area has a radius of curvature of approximately 1.5 inches and the flanges can be about 0.14 inches wide. The spring 90 has a height, H, of about 0.72 inches and is mounted within channels 96 (FIG. 4*c*) of clamp 70. In particular, the spring 90 can be mounted by applying pressure against contact area 92 so that the resulting flexure allows the flanges 94 to engage the channels 96. The spring 90 in combination with the clamp 70 provides enhanced thermal contact between the jacket 30 and rail 22.

The illustrated heater/spring clamp assembly thus has a number of advantages over known heater units. First, the blade-like geometry of the heater jacket allows for a narrow heater thickness at the switch interface while providing a tall heat transfer surface. The heater therefore has a reduced likelihood of impact damage while providing an enlarged heat transfer surface area. The vertical distribution of the heater element strands also provides enhanced heat distribution across the heat transfer surface. The spring clamp mounting assembly insures good heater/rail contact and accommodates normal thermal expansion/contraction. The spring clamp also allows for minimal thickness of the combined heater/mount assembly at the switch interface. Moreover, the heater mount assembly of the present invention allows for efficient, direct conductive heating at the track switch interface. In this regard, certain known heaters recommended use of 300 watts per foot to 500 watts per foot (when employed on the inside or outside of a switch). The heater of the present invention is believed to deliver adequate heat using only 200 to 300 watts per linear foot, thereby yielding significant efficiency advantages.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A heater for a railroad track switch including a first stationary rail having a gauge side and a switching rail having an opposite side, said switching rail being moveable into an engaged position relative to said stationary rail wherein a portion of said opposite side of said switching rail closely abuts a portion of said gauge side of said stationary rail, to form a recess defining a gap at an interface between said portions, said heater comprising:

narrow heater element means disposed on said gauge side of said stationary rail including an elongate, rigid housing formed from metal having a substantially flat, conductive heat transfer surface for conductively transferring heat from said heater element means to said stationary rail, said heat transfer surface having a length of at least about 6 feet aligned with a longitudinal axis of said stationary rail and a vertical height of no less than about 0.5 inches, said heater element means further having a narrow thickness, defined relative to an axis transverse to said heat transfer surface, or no more than about 0.4 inches; and bracket means for engaging said heater element means and securing said heater element means to said gauge side of said stationary rail, said bracket means adapted for removably engaging said stationary rail;

wherein said narrow heater element means is disposed in said gap of said interface between said stationary rail and said switching rail to directly heat said gauge side of said stationary rail via said substantially flat, conductive heat transfer surface for improved heat transfer and reliability.

2. The heater of claim 1, wherein said thickness of said narrow heater element means is no more than about 0.25 inches.

3. The heater of claim 1, wherein said vertical height of said heat transfer surface is at least about 1.0 inch.

4. The heater of claim 1, wherein said heat transfer surface is in contact with said gauge side of said rail across substantially the entirety of said length of said heat transfer surface.

5. The heater of claim 1, wherein said heat transfer surface is in contact with said gauge side of said rail across substantially the entirety of said length of said heat transfer surface, and said length is at least about 12.0 feet.

6. The heater of claim 1, wherein said narrow heater element means comprises first and second heater element portions for heating said heat transfer surface, said heater element portions being substantially vertically aligned and located a vertical distance of at least about 0.25 inches from one another.

7. The heater of claim 1, wherein said narrow heater element means comprises first and second heater elements separated by an electrically insulating material.

8. The heater of claim 1, wherein said narrow heater element means comprises first, second and third elongate heater elements each being electrically isolated from the others by an electrically insulating material.

9. The heater of claim 1, wherein said bracket means comprises means for substantially preventing relative vertical motion between said heater element means and stationary rail and for allowing relative longitudinal motion between said heater element means and said stationary rail.

10. The heater of claim 1, wherein said bracket means comprises a mounting surface for attachment to said stationary rail, bracket means for engaging said heater element means on upwardly facing, horizontally facing and downwardly facing surfaces of said heater element means, said bracket means further being free from contact with said heat transfer surface, and resilient means for urging said heat transfer surface against said stationary rail to as to maintain thermal contact therebetween.

11. The heater of claim 1, wherein said bracket means comprises a bracket for engaging said heater element means, and resilient means disposed between said bracket and said heater element means for urging said conductive heat transfer surface against said stationary rail.

12. A heater for a railroad track switch including a first track rail, said heater comprising:

a heater element assembly comprising an elongate, rigid housing formed from metal for mounting on a substantially vertical side of said rail, said longitudinal housing having a length of at least about 6 feet and including substantially flat, conductive heat transfer surface means for conductively transferring heat from said heater element assembly to said first rail, first elongate heater element means disposed adjacent an upper portion of said heat transfer surface means, for providing heat to said heat transfer surface means, and second elongate heater element means, disclosed adjacent a lower portion of said heat transfer surface means, for providing heat to said heat transfer surface means, said first and second elongate heater element means being substantially vertically aligned and located a vertical distance of at least about 0.25 inches from one another; and bracket means for engaging said heater element assembly and securing said heater element assembly to said rail such that a length of said elongate housing is aligned with a length of said rail, said bracket means adapted for removably engaging said rail.

13. The heater of claim 12, wherein said first elongate heater element means is electrically isolated from said second elongate heater element means.

14. The heater of claim 12, wherein said first and second elongate heater element means are separated by a vertical distance of at least about 0.5 inches from one another.

15. The heater of claim 12 wherein said first elongate heater element means comprises a first electrical resistance strand and said second elongate heater element means comprises a second electrical resistance strand and said heater element assembly further comprises a third electrical resistance strand.

16. The heater of claim 12 wherein said heater element assembly has a thickness of no more than about 0.25 inches.

17. The heater of claim 12 wherein said substantially flat, conductive heat transfer surface means has a vertical height of at least about 1.0 inch.

18. The heater of claim 12, wherein said bracket means comprises means for substantially preventing relative vertical motion between said heater element assembly and said first track rail and for allowing relative longitudinal movement between said heater element assembly and said first track rail.

19. The heater of claim 12, wherein said bracket means comprises a mounting surface for attachment to said first track rail, a bracket for engaging said heater element assembly on upwardly facing, horizontally facing and downwardly facing surfaces of said heater element assembly, said bracket further being free from contact with said heat transfer surface means, and resilient means for urging said heat transfer surface means against said first track rail so as to maintain thermal contact therebetween.

20. The heater of claim 12, wherein said bracket means comprises a bracket for engaging said heater element assembly, and resilient means disposed between said bracket and said heater element assembly for urging said conductive heat transfer surface against said rail.

21. A heater for a railroad track switch including a first stationary rail having a gauge side and a switching rail having an opposite side, said switching rail being moveable into an engaged position relative to said stationary rail wherein a portion of said opposite side of said switching rail closely abuts a portion of said gauge side of said stationary rail, to form a recess defining a gap at an interface between said portions, said heater comprising:

a heater element assembly disposed on said gauge side of said stationary rail including an elongate, rigid housing formed from metal, said housing having a length of at least about 6 feet and including substantially flat, conductive heat transfer surface means for conductively transferring heat from said heater element assembly to said stationary rail, said conductive heat transfer surface means having a height of at least about 0.5 inches, said heater element assembly further including a first elongate heater element portion disposed adjacent an upper portion of said heat transfer surface means and a second elongate heater element portion disposed adjacent a lower portion of said heat transfer surface means, said first and second elongate heater element portions being located a vertical distance of no less than about 0.25 inches from one another; and bracket means for engaging said heater element assembly and securing said heater element assembly to said gauge side of said stationary rail, said bracket means adapted for removably engaging said stationary rail.

22. The heater of claim 21, wherein said heater element assembly has a thickness, measured transversely relative to said gauge side of said stationary rail, of no more than about 0.25 inches.

23. The heater of claim 21, wherein said height of said conductive heat transfer surface means is at least about 1.0 inches.

24. The heater of claim 21, wherein said first elongate heater element portion is electrically isolated from said second elongate heater element portion.

25. The heater of claim 21, wherein said heater element assembly further comprises a third elongate heater element portion wherein each of said first, second and third elongate heater element portions is electrically isolated from the others.

26. The heater of claim 21, wherein said first elongate heater element portion is located a vertical distance of no less than about 0.5 inches from said second elongate heater element portion.

27. The heater of claim 21, wherein said bracket means comprises means for substantially preventing relative vertical motion between said heater element assembly and said stationary rail and for allowing relative longitudinal motion between said heater element assembly and said stationary rail.

28. The heater of claim 21, wherein said bracket means comprises a mounting surface for attachment to said stationary rail, a bracket for engaging said heater element assembly on upwardly facing, horizontally facing and downwardly facing surfaces of said heater element assembly, said bracket further being free from contact with said heat transfer surface means of said heater element assembly, and resilient means for urging said heat transfer surface means against said stationary rail so as to maintain thermal contact therebetween.

29. The heater of claim 21, wherein said bracket means comprises bracket means for engaging said heater element assembly, and resilient means disposed between said bracket means and said heater element assembly for urging said conductive heat transfer surface against said rail.

30. The heater of claim 1, wherein said attachment means comprises:

engagement means for engaging said heater element means;

bolt means for attaching said engagement means to said stationary rail; and vertical adjustment means for varying a vertical distance between said bolt means and said engagement means;

wherein, for a given position of said bolt means on said stationary rail, said engagement means can be moved to provide a desired positioning of said heater element means on said stationary rail.

31. The heater of claim 12, wherein said bracket means comprises:

engagement means for engaging said heater element assembly;

bolt means for attaching said engagement means to said rail; and vertical adjustment means for varying a vertical distance between said bolt means and said engagement means;

wherein, for a given position of said bolt means on said rail, said engagement means can be moved to provide a desired positioning of said heater element assembly on said rail.

* * * * *